United States Patent [19]

Halene

[11] 4,312,206

[45] Jan. 26, 1982

[54] MAKING A SEAMLESS, SPHERICAL CASE

[75] Inventor: Clemens Halene, Duesseldorf, Fed. Rep. of Germany

[73] Assignee: Mannesmann Aktiengesellschaft, Dusseldorf, Fed. Rep. of Germany

[21] Appl. No.: 97,458

[22] Filed: Nov. 26, 1979

[30] Foreign Application Priority Data

Nov. 27, 1978 [DE] Fed. Rep. of Germany ..... 2851620

[51] Int. Cl.[3] ..... B21B 27/06

[52] U.S. Cl. ..... 72/69; 72/105

[58] Field of Search ..... 72/68, 69, 70, 95, 96, 72/105, 106, 370

[56] References Cited

U.S. PATENT DOCUMENTS 3,740,986 6/1973 Schmid ..... 72/106 X

*Primary Examiner*—James M. Meister

[57] ABSTRACT

A tubular blank is held in a bed, heated on one end, which is then rolled into a semisphere with an integral nipple; an adjacent portion of the blank is subsequently heated and stretch-formed by rolling to obtain a spherical continuation of the semisphere, being continued in a cylindrical portion, preferably with a stepped-down section. The remainder of the blank is then cut off.

6 Claims, 4 Drawing Figures

MAKING A SEAMLESS, SPHERICAL CASE

BACKGROUND OF THE INVENTION

The present invention relates to seamless, spherical cases and ball housings; and more particularly, the invention relates to the manufacture of such cases or housings.

Cases of the type to which the invention pertains are, for example, used in wedge valves, control gates, or the like. Conventionally, one has used two forged, semi-spherical case parts and has welded them together. The bearing and support parts for the valve or gate element are subsequently welded into the case; and these parts, including particularly the welding seams, are worked and surface-finished subsequently. This method is disadvantaged by the very fact that the resulting product is welded.

DESCRIPTION OF THE INVENTION

It is an object of the present invention to make a case of the type outlined above as a seamless product.

It is a particular object of the present invention to provide a method, and equipment for carrying out the method, for making a spherical case with a cylindrical extension under utilization of a blank to be worked so that the worked blank already constitutes a case which has almost all, or practically all, of the requisite dimensions, and further working (sizing) is needed to an insignificant extent only.

In accordance with the preferred embodiment of the present invention, it is suggested to provide a tubular blank to be held for rotation by head stock means which slide in a bed. The blank is heated at one end, worked at that portion, e.g., rolled, into a semisphere with an integral nipple; the adjacent blank portion is then heated and worked in a spherical continuation which, in turn, is continued into a cylindrical portion of a reduced diameter. Working is carried out by a contoured roll, combining rolling and stretch forming (drawing).

The case or housing made in accordance with the invention is of spherical configuration with a nipple on one end and a cylindrical portion at the opposite end. This case has nearly the final dimensions and does not require an extensive finishing operation. Moreover, the individual forming and working steps provide a natural texture distribution in the material which is of significant advantage for high-pressure application.

DESCRIPTION OF THE DRAWINGS

While the specification concludes with claims, particularly pointing out and distinctly claiming the subject matter which is regarded as the invention, it is believed that the invention, the objects, and features of the invention, and further objects, features, and advantages thereof will be better understood from the following description taken in connection with the accompanying drawings in which:

Proceeding now to the detailed description of the drawings, FIG. 1 shows a long bed 1 on which run head stocks 2 and 3. These head stocks support hollow spindles 4, being mounted therein for rotation and including clamping means of known construction. These hollow spindles receive a hollow, tubular blank 5.

Figure 1:
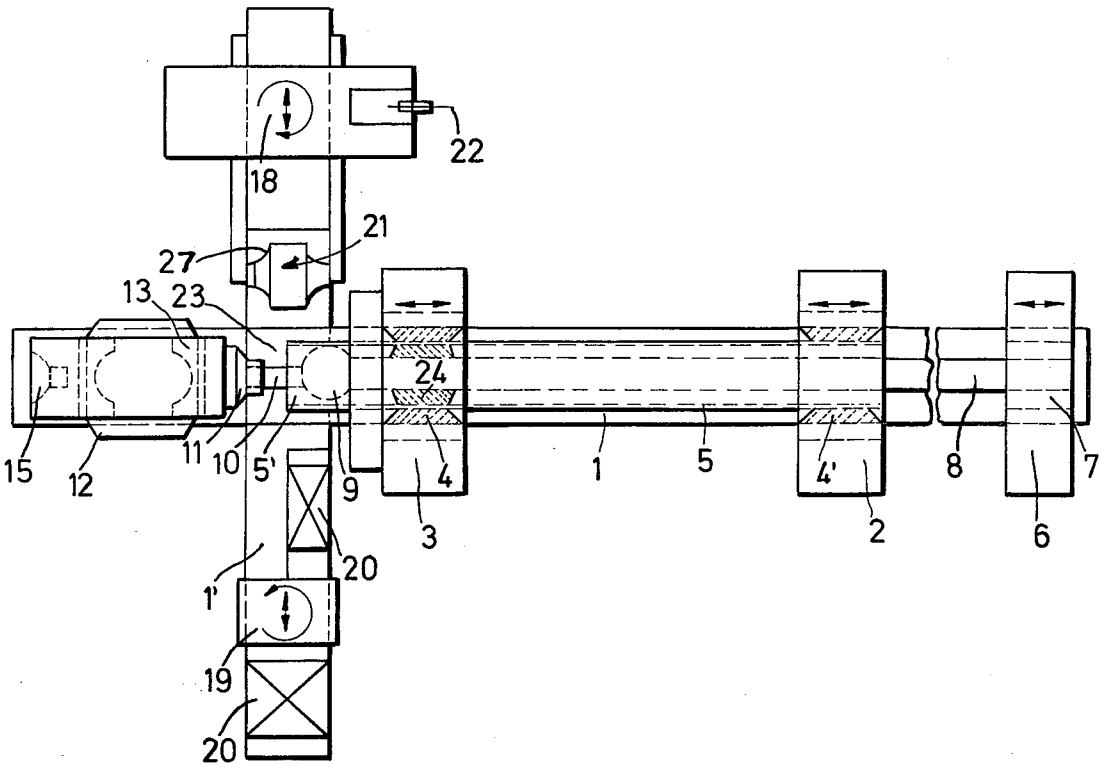
FIG. 1 is a top view of a machine for working a hollow blank into a tubular case, the figure showing also a not yet worked blank as held in the machine.

A carriage 6 is also slidingly disposed on bed 1, and a mandrel rod 8 is clamped to the carriage, 6, by means of clamps 7. A head 9 on rod 8 has, in parts, the contour of a ball, corresponding in size and dimensions to the ball-shaped interior of a case to be formed out of blank 5. The diameter of that ball is approximately equal to the inner diameter of tubular blank 5.

The support, 6, will include a drive for the mandrel rod 8. Moreover, rod 8 includes a clamping device to clamp against the blank from the inside. This way, rotational movement is also imparted upon the blank. Spindles 4 are journalled in head stocks 2 and 3 in order to follow that rotation, i.e., to support the blank while rotating.

Head 9 is provided with a pin 10 which may project into a receiver 11 when the mandrel is in the advanced position as illustrated in FIG. 1. This receiver is a part of a pivotable, turret-like spindle stock 12, also constructed as a carriage for being slidingly disposed on bed 1. The stock and carriage, 12, is provided with a turret 13, whose one end is receiver 11, while the other end is a work holder 15. It can readily be seen that the two devices 6 and 12 are disposed on the bed so that the two head stocks 2 and 3 are situated in between. Both devices 6 and 12 are slidable for the sake of convenience. It is essential, however, that they are movable relative to each other.

A second bed 1′ is disposed transversely to bed 1 to establish a cross-like bed configuration. Supports 18 and 19 are slidably disposed on bed 1′. Support 18 carries a forming tool 21 to be described in detail below. Furthermore, device 18 is constructed as a cross support to carry additionally a cutting device 22. Device 18, thus, includes a carriage part and turret-like holders thereon for tools 21 and 22. These holders can be pivoted on a vertical axis to bring one or the other in linear relation to the extension of bed 1′. Support 19 carries pivotable inductors 20 and 20′. This support 19 includes also a carriage part for linear movement on bed 1′, while the two inductors are mounted on turret-like holders so that one or the other can be made to project towards blank 5.

Bed 1′ runs underneath bed 1, but tool 21 (or 22) is supported on the carriage of support 18 to permit an overhung into a work space area 23 above bed 1 in the area of the crossing. The inductions, 20 and 20′, are analogously mounted on the carriage part of support 19.

In operation, blank 5 is worked as follows. One begins by mounting blank 5 in the two head stocks 2 and 3 (FIG. 1). One end of the blank is directly received in the spindle of stock 2, but the other end of blank 5 projects beyond head stock 3. The mandrel configuration is retracted, but clamping device 24 may, for example, clamp against blank 5 from the inside, adjacent to the hollow spindle 4 in head stock 2. Since the mandrel is driven by its support 6, the blank is, indeed, caused to rotate. Hollow spindles 4 and 4′ as well as mandrel rod 8 rotate at a modest pace. Support 19 is advanced so that annular inductor 20 heats front 5′ of blank 5 which projects into work space 23.

After heating, support and carriage 19 is retracted, and now carriage 6 is advanced so that head 9 extends into the heated region of blank 5 while pin 10 is inserted into receiver 11. Internal clamping device 24 on rod 8 bears against the blank opposite clamping device 4 in head stock 3 to make sure that mandrel rod and blank rotate in unison as rod 8 is driven from within support 6.

Now, carriage and support 18 advances roll 21. The contour part, 25, as well as the cylindrical roll portion 26 work and deform the heated blank end in that particularly the cylindrical roll portion forms the blank end proper into a nipple, and the contiguous contour 25 forms the adjacent portion of the blank into a semisphere, corresponding to one half of the ball-shaped housing to be made. Pin 10 and ball-shaped head 9 serve as internal mandrel support for the ensueing combined drawing- and stretch-forming and rolling operation.

Next, carriage 12 is retracted and so is the mandrel, and turret 13 is turned by 180° so that the contoured clamping device 15 faces the newly deformed blank end. Upon advancing carriage 12 again, this clamping device will receive the newly formed nipple 31 as well as the adjoining portion of the half-sphere that was formed so that, again, the blank is supported from both ends.

The mandrel was retracted so that the head will not be heated by the next heating step. For this, the turret on the carriage of support 19 is turned to have inductor 20' extend towards the blank. The parts are oriented in such a way that the heating involves specifically the portion of the blank directly adjacent to the newly formed semisphere. The blank may have been shifted slightly to the left by means of head stocks 2 and 3. This way, the blank portion to be heated is placed into the work area, 23.

Figure 3:
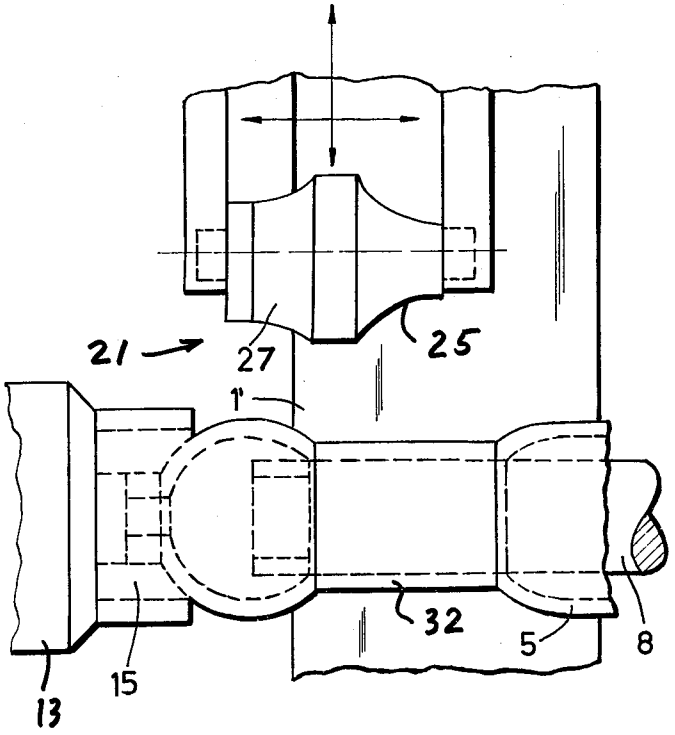
FIG. 3 shows substantially the same portion as FIG. 2, but after completion of forming a second section of the same blank.
Figure 2:
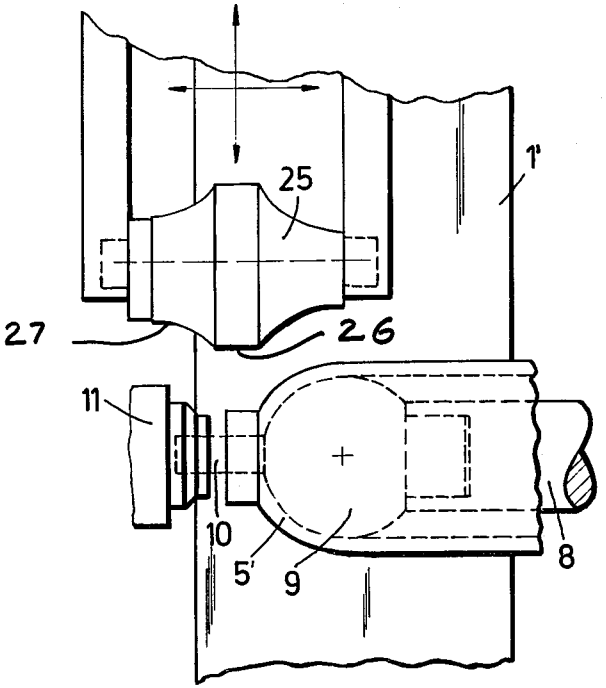
FIG. 2 is an enlarged view of a portion of the machine shown in FIG. 1, showing also completion of forming a first section of the blank into a semisphere.

The mandrel is now returned so that ball 9 is actually placed into the same position it had during the previous working step. The blank supports (2 and 3) and mandrel are now to have a position further to the left as compared with FIG. 2 (or tool 21 is shifted to the right), and now contour 27 of the tool in conjunction with the cylindrical roll portion 26 forms the remaining portion for the case (FIG. 3) to be made. The cylindrical portion 26 of the roll is used further to roll and draw the cylindrical portion 32 of the case.

Specifically, the previously formed semisphere is spherically continued and that continuation is continued further in cylindrical portion 32. The latter portion is extensive so that in stretch-forming fashion tool and blank are moved relative to each other in the direction of the bed.

Upon completion of stretch-forming the cylindrical extension 32 of the spherical case, the turret part of support 18 is turned to place cutter 22 into the work area, and the remainder of the blank is cut off.

Figure 4:
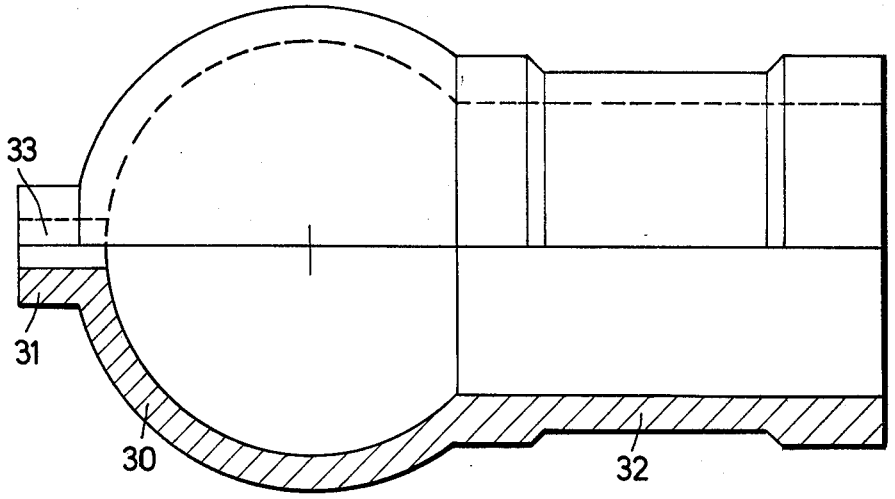
FIG. 4 is a section view through a completed case and housing.

As one can see from FIG. 4, illustrating the finished product, the cylindrical portion 32 is provided with a stepped-down section of reduced wall thickness; the roller, 21, has been advanced here a little further. The internal diameter of the cylindrical portion of the case is determined by mandrel rod 8.

The particular product may next be placed sequentially into a burner with manipulation; into a heating device for partical heating of the ball-shaped housing; and into a forming device for forming sealing and weld nipples for an additional structure to be connected thereto.

The invention is not limited to the embodiments described above, but all changes and modifications thereof not constituting departures from the spirit and scope of the invention are intended to be included.

I claim:

1. A method of making a seamless case having a spherical contour, comprising the steps of providing a tubular blank;

heating one end portion of the blank;

working the one portion into a semisphere integral with a nipple and of a smaller diameter than said blank;

heating a portion of the blank adjacent to the semisphere; and rolling and drawing the latter portion, or a portion thereof, as a partial continuation of the semisphere into a sphere, but continued further in a cylindrical portion having a reduced diameter as compared with the blank.

2. A method as in claim 1, and including the step of reducing the outer diameter of the cylindrical portion over a limited axial length.

3. The product made in accordance with the method as set forth in claim 1 or 2, being a hollow, spherical case having a cylindrical portion on one side and a nipple on the other side.

4. The method as in claim 1, wherein the working step includes contour-rolling one end of the blank into a semisphere.

5. The method as in claim 4, wherein the contour-rolling and said rolling step are carried out by different portions of a single contour roller, and including the step of moving the roller axially along the tube.

6. The method as in claim 5, working the nipple and the semisphere concurrently by different portions of said contour roller.

* * * * *